US006982617B2

(12) United States Patent
Brilon et al.

(10) Patent No.: US 6,982,617 B2
(45) Date of Patent: Jan. 3, 2006

(54) DUAL OUTPUT MAGNETICALLY COUPLED PUSHBUTTON SWITCH

(75) Inventors: Robert J. Brilon, Scottsdale, AZ (US); Anthony J. Van Zeeland, Mesa, AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 0 days.

(21) Appl. No.: 10/721,025

(22) Filed: Nov. 24, 2003

(65) Prior Publication Data

US 2005/0110601 A1 May 26, 2005

(51) Int. Cl.
*H01H 9/00* (2006.01)

(52) U.S. Cl. ..... 335/205; 200/512

(58) Field of Classification Search ..... 335/205–207; 200/5 A, 5 R, 512, 519
See application file for complete search history.

(56) References Cited

U.S. PATENT DOCUMENTS 4,096,364 A * 6/1978 Lynn et al. ..... 200/5 A

* cited by examiner

*Primary Examiner*—Lincoln Donovan
(74) *Attorney, Agent, or Firm*—The Hill Law Firm PLC; Scott A. Hill

(57) ABSTRACT

A magnetically coupled pushbutton switch may be improved by adding protuberances to the top of an armature to create a weak heel on the armature. The protuberances impose a physical barrier which prevents the weak heel from becoming fully magnetically coupled to the magnetic coupler layer, so the initial tactile feedback is lost. Eliminating the double tactile feedback of a magnetically coupled pushbutton switch has some significant advantages over the prior art. Now, a very light actuation force will move an armature with a weak heel from the rest position to a partially actuated position, but without sacrificing any of the final tactile feedback. The improved armature design also makes it possible to use a magnetically coupled pushbutton switch to produce a dual output. The initial travel of a dual output switch does not create any feedback to the user, so there is no longer a need to stabilize the bottom of the heel end of the armature. A dual output armature can electrical connect a common electrical conductor placed under the heel end of the armature to two separate electrical conductors positioned under the toe end of the armature such that there is no output until the armature is fully actuated, at which time all three electrical conductors are simultaneously electrically connected by the dual output armature.

20 Claims, 3 Drawing Sheets

DUAL OUTPUT MAGNETICALLY COUPLED PUSHBUTTON SWITCH

BACKGROUND OF THE INVENTION

Magnetically coupled pushbutton switches, exemplified in FIGS. 1–4, normally have an electrically conductive armature 2 that is magnetically held by a magnetic coupler layer 4 in a rest position, as in FIG. 1, spaced from electrical conductors 6 and 7 on a non-conductive substrate layer 8. A user-provided actuation force applied to a crown 10 of the armature (usually stamped sheet metal that is silver plated) causes it to snap free of the magnetic coupler layer and close the electrical conductors by electrically connecting them. Withdrawal of the actuation force allows the magnetic coupler layer to attract the armature back to the rest position, resulting in a reopening of the switch. A non-conductive spacer layer 12 (such as high density foam) is adhesively fixed to the substrate layer, with a cavity 14 in the spacer layer exposing the electrical conductors. The magnetic coupler layer overlies the spacer layer. The armature is magnetically coupled to the bottom of the magnetic coupler layer so that the armature is housed within the cavity in the spacer layer. The armature's crown protrudes through an aperture 16 in the magnetic coupler layer. Typically, a polyester spacer and overlay 18 with suitable graphics overlies the magnetic coupler layer to seal the pushbutton switch and to direct a user as to location and function of the switch.

Magnetically coupled pushbutton switches of the prior art, as shown and described in U.S. Pat. Nos. 5,523,730, 5,990,772, 6,262,646, and 6,556,112, incorporated herein by reference but not limitation, all have an armature piece-part that can travel through a unique pivot/click (FIG. 2/FIG. 3) movement designed to create a very distinct tactile feedback to a switch user. FIG. 2 shows that application of an actuation force 20 causes a heel end 22 of the armature to break away from the magnetic coupler layer 4 and travel to the substrate layer 8 where the feet 24 on the heel end stop (creating an initial tactile feedback) and function as a fulcrum for the armature. FIG. 3 shows that continued application of the actuation force causes a toe end 26 of the armature to abruptly break away from the magnetic coupler layer so that the toe end contacts the substrate layer (creating a final tactile feedback). The exploded view in FIG. 4 shows two commonly used electrical conductor arrangements. The single pole arrangement has the armature's heel end contact a single electrical conductor 6 before the armature's toe end contacts the common electrical conductor 7, so the armature electrically connects them. The double pole arrangement has the armature's heel end contact a pair of electrical conductors, 28 and 29, electrically connecting them, and then the armature's toe end travels into contact with the common electrical conductor 7, thereby electrically connecting all of the electrical conductors to each other.

A common characteristic of most magnetically coupled pushbutton switches is that the armatures only reliably contact the substrate layer in three places, in a stable tripod support configuration. The drawback is that the heel end of an armature must be stable or there will not be a consistent initial and final tactile feedback. If two of the tripod supports are under the feet, which is the case in the prior art, there is only one remaining reliable tripod support location. This third tripod support, which will also be the third reliable contact point, is located at the toe end of the armature. Granted, excessive actuation force will cause more than three places to contact, but the reliability is poor.

SUMMARY OF THE INVENTION

The present invention is a magnetically coupled pushbutton switch which uses protuberances to create a weak heel on the armature. The protuberances impose a physical barrier which prevents the weak heel from ever being magnetically coupled to the magnetic coupler layer in the way taught by the prior art. The prior art taught that the armature's rest position should be substantially adjacent the magnetic coupler layer, thus utilizing the maximum magnetic attractive force available. A position that would have been referred to as a "break away" position in the prior art is the rest position of the present invention. Because the weak heel is not allowed to fully return to the magnetically coupled position, the first tactile feedback is lost or, if desired, only barely noticeable. Eliminating the double tactile feedback is, in itself, a significant advantage over the prior art. Now, a very light actuation force will move an armature with a weak heel from the rest position to a partially actuated position. The protuberances so significantly reduce the force required to place a magnetically coupled pushbutton switch into the partially actuated position that it opens up new markets for the switch. For example, a magnetically coupled switch according to the present invention can be used as the shutter button on an auto-focus camera that sets the focus when the shutter button is partially actuated. With the switch of the present invention, the actuation force required to "set the focus" is so significantly lower than the force required to "snap a picture" that the fear of accidentally taking an unwanted picture is greatly reduced.

Perhaps even more significant is that the switch of the present invention is ideally suited for producing a dual output. Because the only tactile feedback of the switch of the present invention occurs when the armature is moved into the fully actuated position, there is no longer a need to stabilize the bottom of the heel end of the armature. Instead, the bottom of the heel end of the armature can be flat and function as the first tripod support, which is preferably the common contact point. Because this support is flat, the armature will not significantly rock to one side during actuation. The benefit is that the second and third tripod supports can now be placed on either side of the toe end of the armature so that there are two contact points that can be electrically connected to the common contact point simultaneously. In the prior art, the heel end of the armature would connect a pair of electrical conductors, 28 and 29 in FIG. 4, before a common electrical conductor 7 could be electrically connected to the armature. There was no way around this problem if there was a voltage difference between all of the electrical conductors. The present invention has overcome this obstacle so that even if the common and the pair of electrical conductors are all at different voltages, there will not be a current flow between the toe end pair of electrical conductors because they will simultaneously see and follow the path of least resistance, which is to the grounded heel end of the armature.

DETAILED DESCRIPTION OF THE INVENTION

Figure 5:
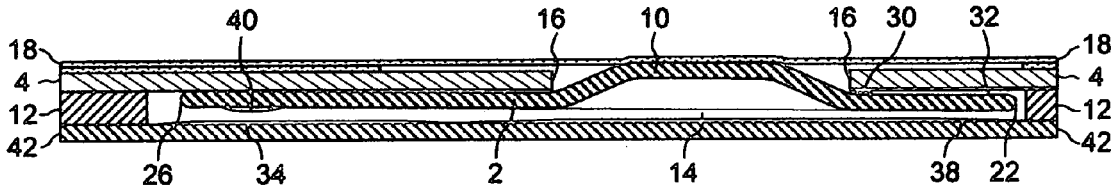
FIG. 5 is a cross-section of a magnetically coupled pushbutton switch of the present invention in the rest position.
Figure 6:
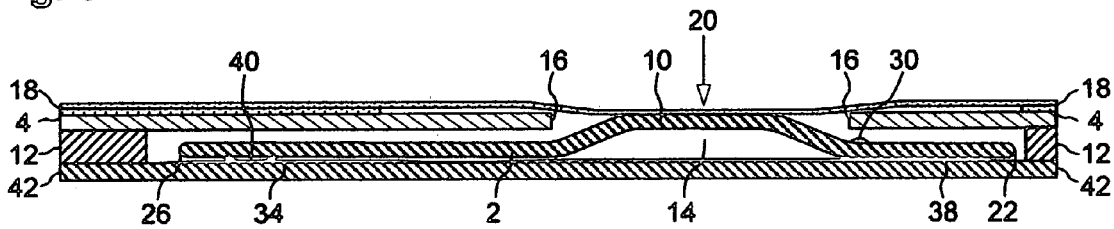
FIG. 6 is a cross-section of the switch of FIG. 5 in the fully actuated position.
Figure 7:
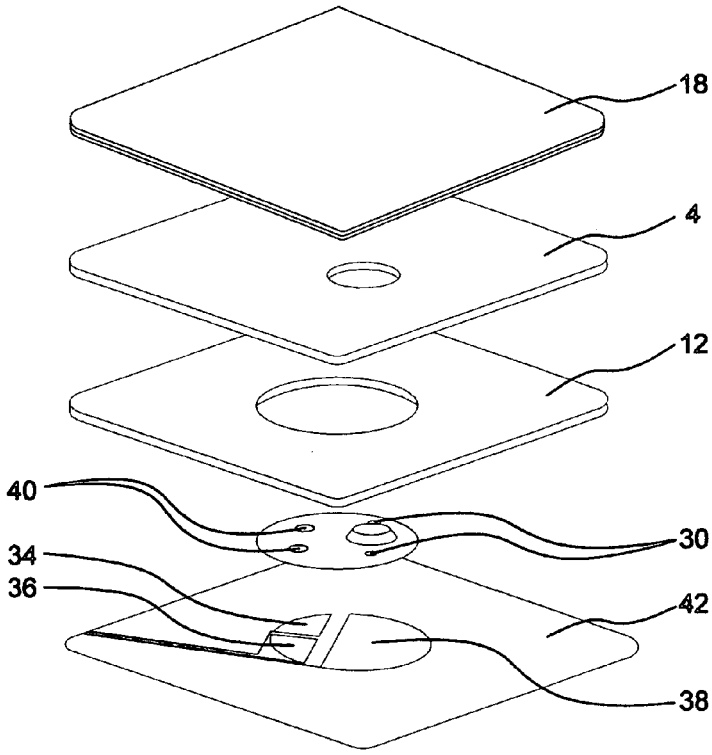
FIG. 7 is an exploded perspective view of the switch of FIG. 5, clearly showing a dual output configuration.

FIGS. 5 through 7 show a magnetically coupled pushbutton switch according to the present invention. The armature design and electrical conductor arrangement of the switch are the focus of the present invention, but an understanding of how a magnetically coupled pushbutton switch operates is necessary. The fundamental parts of a magnetically coupled pushbutton switch have already been described in the background section of this specification, and the same numbers carry substantially the same meaning in any of the several drawings in this specification. U.S. Pat. No. 6,556,112 includes a more detailed description of the parts, materials, construction and assembly of a magnetically coupled pushbutton switch, but that patent's reference numbers are different than those used in this description.

The only moveable part of a magnetically coupled pushbutton switch is the armature 32, a substantially flat piece of magnetic material that is electrically conductive. Soft steel coated with silver is a suitable armature material. The armature usually includes a crown 10 that stands above the otherwise flat sheet of armature material. The crown is located much closer to a heel end 22 of the armature. The end of the armature opposite the heel end is a toe end 26. When the armature is magnetically coupled to the bottom of the magnetic coupler layer 4, the crown of the armature protrudes through an aperture 16 in the magnetic coupler layer.

Figure 1:
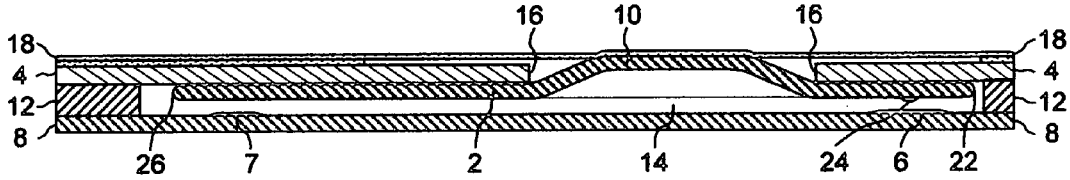
Fig. 1 Prior Art
FIG. 1 is a cross-section of a prior art magnetically coupled pushbutton switch in the rest position.

As most clearly seen in the prior art, there are three stable positions that a magnetically coupled pushbutton switch may experience. FIG. 1 shows a first stable position, the rest position, where the armature 2 is magnetically coupled to the magnetic coupler layer 4. In the absence of any external force, the armature will position itself within the cavity 14 such that the crown 10 of the armature lies substantially within the aperture 16 in the magnetic coupler layer while the substantially flat part of the armature couples to the bottom surface of the magnetic coupler layer. The protruding part of the crown causes the polyester spacer and overlay 18 to bulge slightly, giving a user a better indication of the location of the switch. Because the overlay receives an upward push from the crown of the armature, the crown of the armature receives an equal but opposite downward force from the overlay. This condition, where the overlay supplies a slight downward force on the crown of the armature, is called preload.

Figure 2:
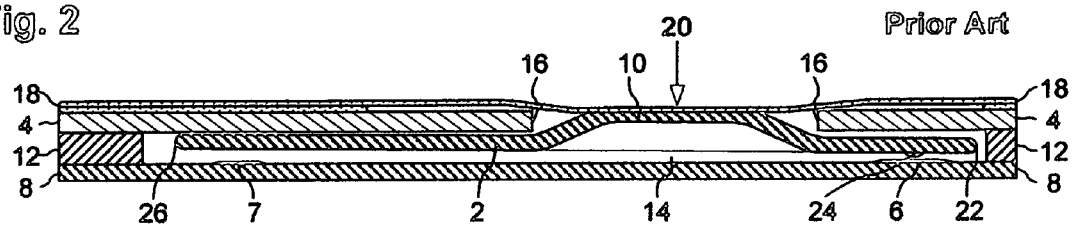
Fig. 2 Prior Art
FIG. 2 is a cross-section of the switch of FIG. 1 in a partially actuated position, with the heel end of the armature acting as a fulcrum.

FIG. 2 shows the second stable position, where the magnetically coupled pushbutton switch is in a partially actuated position. The partially actuated position is where the heel end 22 of the armature 2 has broken away from the magnetic coupler layer 4 and traveled into contact with the substrate layer 8, causing the initial tactile feedback, but the toe end 26 of the armature has not significantly moved from its rest position. The armature travels into the partially actuated position after a user provided actuation force 20 is applied to the top surface of the polyester spacer and overlay 18, above the crown 10 of the armature.

Figure 3:
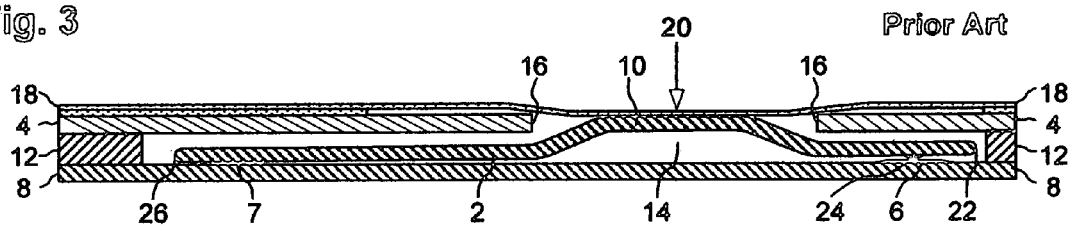
Fig. 3 Prior Art
FIG. 3 is a cross-section of the switch of FIG. 1 in the fully actuated position.
Figure 4:
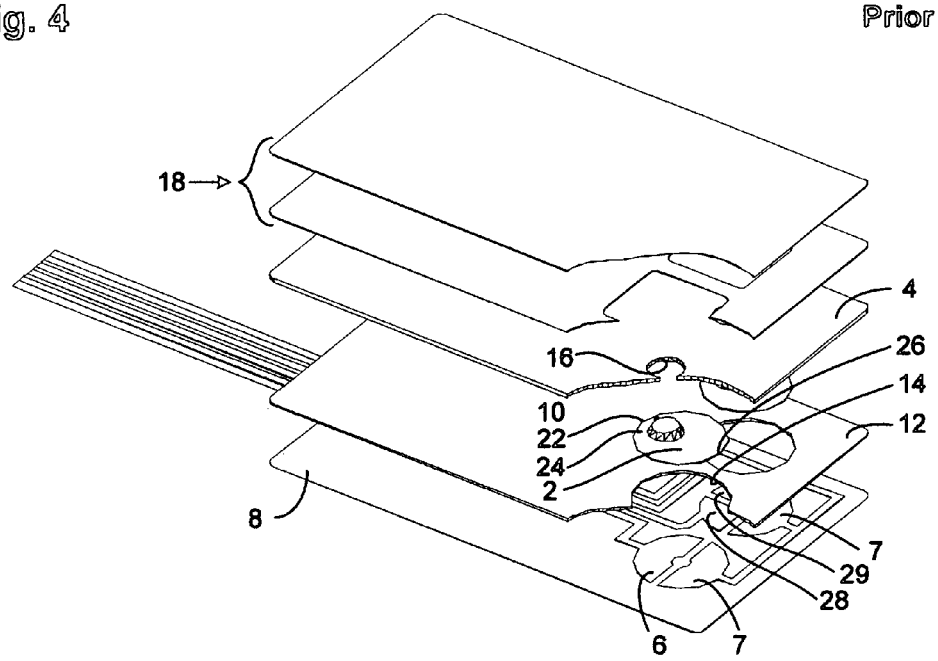
Fig. 4 Prior Art
FIG. 4 is an exploded perspective view of a prior art magnetically coupled pushbutton switch.

FIG. 3 shows the third stable position, where the magnetically coupled pushbutton switch is in the fully actuated position. The fully actuated position is where the heel end 22 and the toe end 26 of the armature 2 have successively broken away from the magnetic coupler layer 4 and traveled to the substrate layer 8. The armature will always travel to the partially actuated position before traveling to the fully actuated position. In the prior art, if a user applied actuation force 20 was applied slowly, a user felt the initial tactile feedback through the polyester spacer and overlay 18 indicating that the partially actuated position had been achieved. With continued application of the actuation force, the user felt the final tactile feedback indicating that the fully actuated position had been achieved.

Many of the magnetically coupled armatures of the prior art are capable of being modified to include the protuberances of the present invention. With that understanding, the most preferred armature design, shown in FIG. 8, has two protuberances 30 that are on either side of the crown 10. The protuberances are preferably equidistant from the center of the armature, and equidistant from the center of the crown. A typical armature 32 is made from a sheet of ¼ mm soft steel coated with silver, so it is magnetic and electrically conductive. A typical armature is stamped, or otherwise formed, as a disc having a diameter of about 15 mm, with a crown that raises above the top surface of the armature by about 1½ mm. Two toe pads 40, located near the toe end 26, depend from the bottom surface of the armature by about ⅛ mm. For such an armature, the protuberances should raise above the top surface of the armature by about ⅛ mm to ¼ mm, creating an equivalently sized gap 33 between the heel end 22 and the magnetic coupler layer 4. Adjustments in the height of the protuberances will affect the tactile feedback to a user, so preference may be used to achieve a desired performance. The amount of preload designed into a particular switch assembly will also affect the tactile feedback, but the height of the protuberances can be adjusted to compensate for a particular preload force.

In a first preferred embodiment, a magnetically coupled pushbutton switch of the prior art is improved to include the armature 32 of the present invention. The protuberances 30 of the improved armature are on either side of the crown 10, and the protuberances and crown are raised with respect to the top surface of the armature, but the crown is higher than the protuberances. Two feet 24 depend from the bottom surface of the armature at the heel end 22. Alternatively, a single bar foot may depend from the bottom surface of the armature at the heel end. A very soft actuation force 20 will move the armature into the second stable position because the protuberances only allow the heel end to be weakly held to the magnetic coupler layer 4. When the armature travels into the second stable position, there is almost no perceptible initial tactile feedback. Full actuation of the switch into the third stable position, however, creates a very distinct final tactile feedback and requires significantly more actuation force. The total travel time required for full actuation of the switch may be very short, even less than twenty thousandths of a second, but a switch user can easily support the armature in the partially actuated position for many seconds using minimal effort.

For a double pole switch, the electrical conductors are arranged on the substrate layer 8 so that the pair of electrical conductors 28 and 29 are located under the two feet 24 at the heel end 22 of the armature 32, and the common electrical conductor 7 is located generally under the toe end 26 of the armature. The pair of electrical conductors is actuated when the armature is manipulated into the second stable position such that the pair of electrical conductors is electrically connected by the two feet. The common electrical conductor may then be electrically connected to the pair of electrical conductors by fully actuating the armature into the third stable position. Please note that which electrical conductor is actually common may be changed around.

Figure 8:
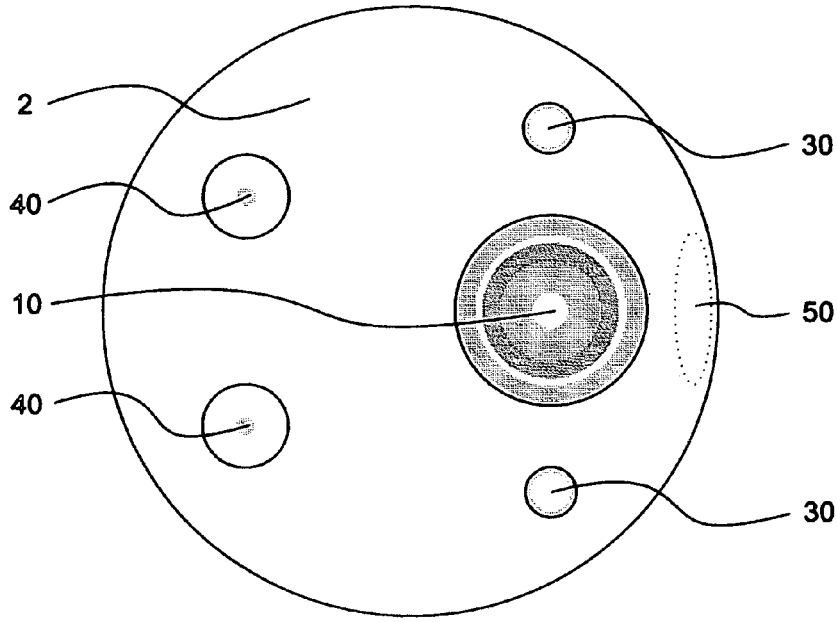
FIG. 8 is a detailed plan view of a dual output armature according to the present invention.
Figure 9:
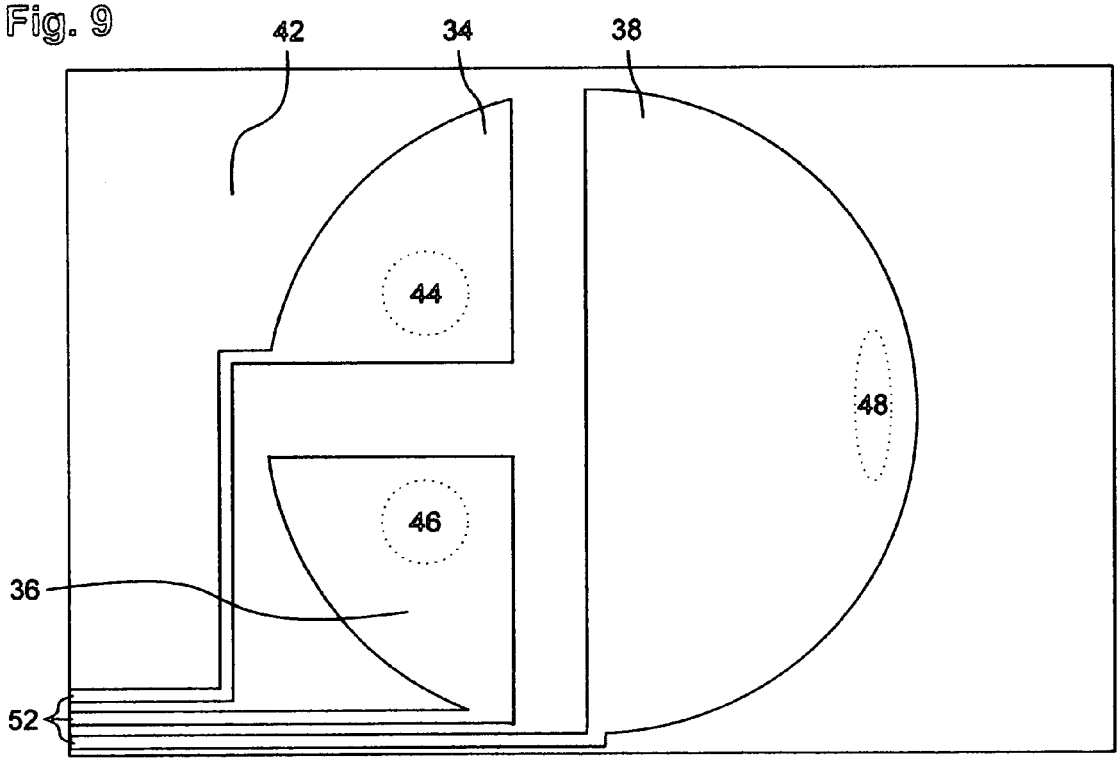
FIG. 9 is a detailed plan view of a dual output circuit on a substrate layer of the present invention.

In a second preferred embodiment, the electrical conductors are arranged to produce a dual output, as shown in FIG. 9. FIG. 8 shows a dual output armature 32 that is uniquely structured so that three dual output contact points (first, second and common) on the bottom surface of the armature will electrically connect three dual output electrical conductors (first, second and common) simultaneously. The dual output armature includes the protuberances 30 already described, and two toe pads 40 that depend from the bottom surface of the armature. Because the protuberances close the space between the heel end 22 of the armature and the dual output substrate layer 42, while eliminating the undesired double tactile feedback, there is no longer a need for feet depending from the heel end of the armature. This makes it possible to stabilize a single common armature contact point 50, rather than having the two contact points that were required in the prior art.

When the dual output armature 32 is manipulated by a user provided actuation force 20 into the second stable position, the armature's first point of contact with the dual output substrate layer 42 will be where the common armature contact point 50 meets the common dual output electrical contact point 48 on the common dual output electrical conductor 38. When the dual output armature is forced to travel into the third stable position, the toe pads 40 make contact at the first and second dual output contact points 44 and 46, thereby electrically connecting the armature to the first and second dual output electrical conductors 34 and 36, respectively. A stable tripod configuration is formed by the three contact points if the dual output armature is fully actuated into the third stable position.

The dual output switch's substrate electrical conductor arrangement takes advantage of this stable tripod configuration that is consistent and reliable. It is highly recommended that the common dual output electrical conductor 38 be at the heel end 22 of the armature 32. The common dual output electrical conductor is much larger than the other electrical conductors just in case the actual common dual output contact point 48 shifts around. The common dual output electrical conductor is large enough to cover the entire region on the dual output substrate layer 42 that may be contacted by the substantially flat heel end of the armature. The first and second dual output electrical conductors 34 and 36 may be smaller because they will be electrically connected to the armature at the toe pads 40 only. Electrical leads 52 connect the electrical conductors to electronics that are external to the switch.

Final travel of the dual output armature is fairly abrupt, so the toe pads hit the dual output substrate layer 42 almost simultaneously. When an electrical conductor touches one of the armature's toe pads, the flow of charge will be toward the common of the circuit because it provides the greatest potential difference. Even if there is a potential difference between the toe pads, there is no flow of current between them because the common electrical conductor is always the first to connect to the circuit and the last to disconnect from the circuit. When the actuation force is removed from the crown of the armature, the toe end strongly returns to the magnetic coupler layer. The heel end weakly returns to the magnetic coupler layer only after the toe end has removed itself from the circuit.

An alternative embodiment of the present invention has the protuberances imposed onto the top of the armature's heel end. An example of imposed protuberances would be small posts that are formed in the magnetic coupler layer. The small posts could be debossed into the magnetic coupler layer in close proximity to the aperture that accepts the crown of the armature. An armature of the prior art would not, in this alternative design, need to be modified because all of the benefits of having a weak heel will be present in an armature whose heel end is blocked by the small posts from ever being strongly held adjacent the magnetic coupler layer in the way taught by the prior art.

While a preferred form of the invention has been shown and described, it will be realized that alterations and modifications may be made thereto without departing from the scope of the following claims. For example, the protuberances do not need to be formed by stamping or molding the armature. A couple of drops of epoxy, or other material that can be fixed to the armature, could take the place of the protuberances already shown and described, and the added material will create the gap that blocks the heel end of the armature from fully returning to the strong magnetically coupled position that is not desired in the switch of the present invention. Also, there are numerous other shapes, sizes and constructions of armatures that have been disclosed in the prior art, and it is expected that this teaching will enable one skilled in the art to incorporate the protuberances of the present invention onto virtually any magnetically coupled pushbutton switch armature.

What is claimed is:

1. An improved armature, for use with a magnetically coupled pushbutton switch of the type at least having a magnetic coupler layer and a substrate layer, the armature comprising:

an electrically conductive magnetic material having a top surface and a bottom surface;

a crown that raises above the top surface, the crown being closest to a heel end of the armature and farthest from a toe end of the armature; and at least one protuberance that is closer to the heel end than to the toe end such that when the armature is in a rest position within the magnetically coupled pushbutton switch, there is a gap between the magnetic coupler layer and the heel end of the armature.

2. The armature of claim 1 further comprising one or more feet that are closer to the heel end than to the toe end, the feet depending below the bottom surface of the armature.

3. The armature of claim 1 wherein the armature is stamped to include the crown and the at least one protuberance.

4. The armature of claim 1 wherein the crown is attached to the top surface.

5. The armature of claim 1 wherein the at least one protuberance is symmetrical with a second protuberance such that the two protuberances are substantially equidistant from the crown, and the two protuberances are substantially equidistant from the center of mass of the armature.

6. The armature of claim 1 wherein the at least one protuberance lies between the heel end and the crown.

7. The armature of claim 1 further comprising toe pads that depend from the bottom surface closer to the toe end than to the heel end.

8. The armature of claim 1 wherein the electrically conductive magnetic material is a magnetic material that has been plated so that it is electrically conductive.

9. A dual output magnetically coupled pushbutton switch comprising:

a magnetic coupler layer having an aperture;

a dual output armature made from an electrically conductive magnetic material having a top surface and a bottom surface;

a crown in the dual output armature that rises above the top surface, the crown being closest to a heel end of the armature and farthest from a toe end of the armature;

at least one protuberance in the dual output armature that is closer to the heel end than to the toe end such that when the dual output armature is in a rest position within the dual output magnetically coupled pushbutton switch, there is a gap between the magnetic coupler layer and the heel end of the armature;

a spacer layer having a cavity in which the dual output armature is housed; and a substrate layer that carries electrical conductors of the switch.

10. The dual output magnetically coupled pushbutton switch of claim 9 wherein the at least one protuberance is symmetrical with a second protuberance such that the two protuberances are substantially equidistant from the crown, and the two protuberances are substantially equidistant from the center of mass of the dual output armature.

11. The dual output magnetically coupled pushbutton switch of claim 9 further comprising a foot that is closer to the heel end than to the toe end, the foot depending below the bottom surface of the dual output armature.

12. The dual output magnetically coupled pushbutton switch of claim 9 wherein the crown and at least one protuberance are stamped into the dual output armature.

13. The dual output magnetically coupled pushbutton switch of claim 9 further comprising two toe pads that depend from the bottom surface closer to the toe end than to the heel end.

14. The dual output magnetically coupled pushbutton switch of claim 9 wherein the at least one protuberance is formed into the magnetic coupler layer to create the gap between the magnetic coupler layer and the heel end of the armature.

15. A single tactile magnetically coupled pushbutton switch comprising:

a magnetic coupler layer having an aperture;

an armature made from an electrically conductive magnetic material having a top surface and a bottom surface;

a crown in the armature that rises above the top surface, the crown being closest to a heel end of the armature and farthest from a toe end of the armature;

at least one protuberance in the armature that is closer to the heel end than to the toe end such that when the armature is in a rest position within the single tactile magnetically coupled pushbutton switch, there is a gap between the magnetic coupler layer and the heel end of the armature;

a spacer layer having a cavity in which the dual output armature is housed;

a substrate layer that carries electrical conductors of the switch;

a first stable position of the switch, where the armature is magnetically coupled to the magnetic coupler layer in a rest position;

a second stable position of the switch, where the armature is partially actuated such that the heel end of the armature has broken away from the magnetic coupler layer and traveled to the substrate layer, but the toe end of the armature is in contact with the magnetic coupler layer; and a third stable position of the switch, where the heel end of the armature and the toe end of the armature are in contact with the substrate layer, in a fully actuated position.

16. The single tactile magnetically coupled pushbutton switch of claim 15 further comprising one or more feet that are closer to the heel end than to the toe end, the feet depending below the bottom surface of the armature.

17. The single tactile magnetically coupled pushbutton switch of claim 16 wherein the electrical conductors are arranged such that a pair of electrical conductors is electrically connected by the feet when the switch is in the second stable position, and a third electrical conductor is electrically connected to the pair of electrical conductors when the switch is in the third stable position.

18. The single tactile magnetically coupled pushbutton switch of claim 16 wherein a single foot lies between the heel end and the crown, and wherein there are two protuberances, one on either side of the crown, such that the protuberances are equidistant from the foot and the crown.

19. The single tactile magnetically coupled pushbutton switch of claim 15 further comprising two toe pads that depend from the bottom surface closer to the toe end than to the heel end.

20. The single tactile magnetically coupled pushbutton switch of claim 19 wherein the electrical conductors are arranged such that a common electrical conductor is electrically connected to the heel end of the armature when the switch is in the second stable position, and at least one additional electrical conductor is electrically connected to the armature at one of the toe pads when the switch is in the third stable position.

* * * * *